US007801318B2

(12) United States Patent
Barthel

(10) Patent No.: US 7,801,318 B2
(45) Date of Patent: Sep. 21, 2010

(54) HEARING AID DEVICE WITH MEANS FOR FEEDBACK COMPENSATION

(75) Inventor: Roland Barthel, Erlangen (DE)

(73) Assignee: Siemens Audiologisch Technik GmbH, Erlangen (DE)

( * ) Notice: Subject to any disclaimer, the term of this patent is extended or adjusted under 35 U.S.C. 154(b) by 1154 days.

(21) Appl. No.: 11/440,817

(22) Filed: May 25, 2006

(65) Prior Publication Data

US 2006/0285709 A1 Dec. 21, 2006

(30) Foreign Application Priority Data

Jun. 21, 2005 (DE) ..... 10 2005 028 742

(51) Int. Cl.
*H04R 25/00* (2006.01)
*H04R 29/00* (2006.01)

(52) U.S. Cl. ..... 381/312; 381/315; 381/318; 381/60

(58) Field of Classification Search ..... 381/312, 381/318
See application file for complete search history.

(56) References Cited

U.S. PATENT DOCUMENTS 4,689,820 A * 8/1987 Kopke et al. ..... 381/315
5,259,033 A 11/1993 Goodings et al.
5,402,496 A 3/1995 Soli et al.
5,524,150 A * 6/1996 Sauer ..... 381/309
6,219,427 B1 * 4/2001 Kates et al. ..... 381/318
6,398,858 B1 6/2002 Yu et al.
2002/0176584 A1 * 11/2002 Kates ..... 381/60
2003/0161492 A1 8/2003 Miller et al.
2004/0013280 A1 * 1/2004 Niederdrank ..... 381/315
2005/0047620 A1 3/2005 Fretz
2005/0190929 A1 9/2005 Sporer et al.

FOREIGN PATENT DOCUMENTS

EP 0557847 A1 9/1993
EP 0581261 A1 2/1994
EP 581261 A1 * 2/1994
EP 1439736 A1 7/2004
WO 2004047484 A1 6/2004

* cited by examiner

*Primary Examiner*—Brian Ensey
*Assistant Examiner*—Sunita Joshi

(57) ABSTRACT

With a hearing aid device, filter parameters of filters are to be adjusted for feedback suppression. It is hereby proposed that test signals are emitted via an earpiece in order to estimate the transmission behavior of the feedback path, and response signals to these test signals are recorded by a microphone and analyzed in the hearing aid device. In this way, information signals which are already occasionally emitted by the hearing aid device and can be perceived by the user are used as test signals. Information signals of this type are particularly well suited as test signals and are perceived by the user as non-interfering.

20 Claims, 1 Drawing Sheet

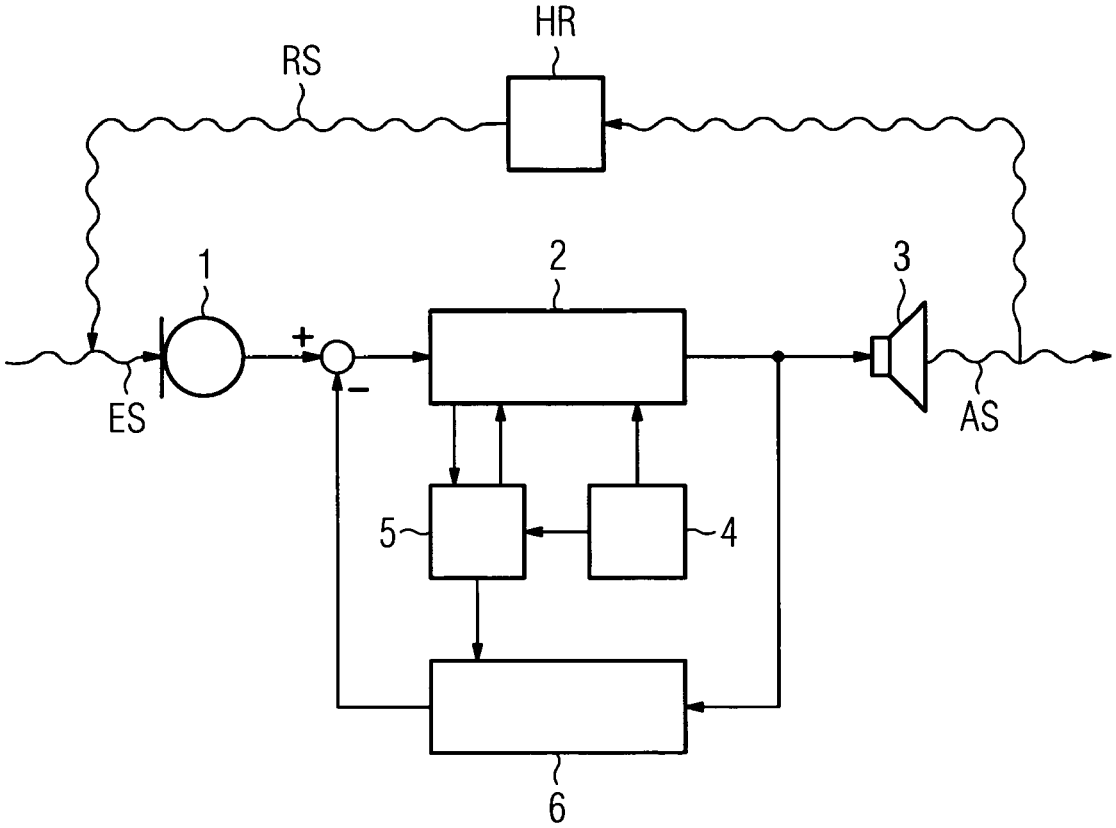
HR
RS
1
2
3
+
−
ES
AS
5
4
6

HEARING AID DEVICE WITH MEANS FOR FEEDBACK COMPENSATION

CROSS REFERENCE TO RELATED APPLICATIONS

This application claims priority of German application No. 10 2005 028 742.5 filed Jun. 21, 2005, which is incorporated by reference herein in its entirety.

FIELD OF THE INVENTION

The present invention relates to a hearing aid device with an input converter for recording an input signal and converting said signal into an electrical signal, a signal processing unit for processing the electrical signal, an output converter for converting the processed, electrical signal into an output signal which can be perceived by a user as an acoustic signal, a feedback reduction device for adjustably reducing or attenuating a feedback signal contained in the input signal, a signal source for emitting a test signal indirectly originating from the input signal through the output converter, a measuring device for detecting a response signal originating from the emitted test signal from the input signal and an evaluation and control device for adjusting parameters of the feedback reduction device on the basis of the response signal.

BACKGROUND OF THE INVENTION

With hearing aid devices, unwanted feedback of the audio signal emitted to the microphone of the hearing aid device by the earpiece frequently occurs. Feedbacks occur over different feedback paths. A path of this kind is for instance the sound transmission in air, when the ear mold of a behind-the-ear hearing aid device or the housing of an in-the-ear hearing aid device does not adequately seal the auditory canal to the outside. A further feedback path possibly exists across the bones of the hearing aid wearer back to the hearing aid device. If the hearing aid device amplification is greater than the feedback attenuation, the feedback becomes noticeable due a whistling of the hearing aid device, which is very unpleasant for the hearing aid wearer. With stable systems, in which the hearing aid device amplification is smaller than the feedback attenuation, a feedback compensation is not mandatory. Nevertheless, if feedback compensation is carried out, it could possibly result in artifacts.

Feedback can hereby be avoided in some cases such that the amplification of specific frequencies or frequency ranges is reduced. This approach occasionally results in a deterioration of the speech intelligibility when an appropriate hearing aid device is used.

Another approach to feedback reduction is the use of an adaptive filter. In this way, the feedback path is analyzed continually or at specific time intervals. The output signal of the adaptive filter is set such that it neutralizes the feedback part in the input signal of the hearing aid device.

The use of an adaptive filter for feedback compensation in a hearing aid device is known from U.S. Pat. No. 5,259,033. A noise signal is continuously generated so as to estimate the feedback path, said noise signal being emitted via the earpiece of the hearing aid device, such that a response signal recorded by the microphone of the hearing aid device as a response to this noise can be evaluated. Filter parameters are then adjusted such that the signal fed back is suppressed.

A hearing aid device with a feedback reduction device is known from U.S. Pat. No. 5,402,496, in which two different operation modes are distinguished. In the normal operation mode of the hearing aid device, an input signal containing a feedback part is recorded by a microphone, amplified in an amplifier and emitted via an earpiece. A feedback suppression with permanently adjusted filter parameters is carried out. With a second operation mode of the known hearing aid device which takes place from time to time, the signal path between the microphone and the earpiece is interrupted. A test signal is generated in the hearing aid device and output via the earpiece, such that it is recorded by the microphone as a response signal after passing through the feedback path. Following an evaluation of the response signal, the parameters of the feedback reduction device are reset and retained as a long as possible until the hearing aid device switches again into the second operation mode.

The test signals generated in conjunction with the feedback compensation are disadvantageous in terms of the known hearing aid devices, said test signals either only covering a section of the frequency range which can be transmitted by the hearing aid device or however also comprising signal parts which can be perceived by the user and are thus found to be interfering.

SUMMARY OF THE INVENTION

The object of the present invention is thus to achieve the best possible measurement of the feedback path, without having to emit test signals from the hearing aid device which are perceived by the user as interfering.

This object is achieved with a hearing aid device of the type mentioned at the start, such that information signals which can be perceived by the user can be emitted from the hearing aid device, with the information signals being emitted from the signal source and being used as test signals.

By way of example, a hearing aid device according to the invention is a hearing aid device which can be worn behind the ear, a hearing aid device which can be worn in the ear, an implantable hearing aid device or a pocket hearing aid device. Furthermore, the hearing aid device according to the invention can also be part of a hearing aid device system comprising a number of devices for serving hearing impaired persons, such as for instance part of a hearing aid device system with two hearing aid devices worn on the head for binaural coverage, part of a hearing aid device system with a hearing aid device which can be worn on the head and an external processor unit which can be worn on the body, part of a completely or partially implantable hearing aid device system with a number of components, part of a hearing aid device system with a number of components, part of a hearing aid device system with external additional components such as a remote controller or an external microphone unit etc.

A hearing aid device comprises an input converter for recording an input signal. The input converter is generally designed as a microphone that records an acoustic signal and converts said signal into an electrical signal. However, units are also considered as input converters which comprise a coil or an antenna and which record an electromagnetic signal and convert said signal into an electrical signal. A hearing aid device further conventionally comprises a signal processing unit for processing and frequency-dependently amplifying the electrical signal. A preferably digital signal processor (DSP) serves the purpose of signal processing in the hearing aid device, the mode of operation of which can be influenced by means of programs and/or parameters which can be transmitted to the hearing aid device. The mode of operation of the signal processing unit can be adapted both to the individual hearing loss of a hearing aid device wearer as well as to the current hearing situation in which the hearing aid device is currently being operated. The electrical signal modified in this way is then finally fed to an output converter. This is generally designed as an earpiece which converts the electrical output signal into an acoustic signal. Other embodiments are however also possible here, e.g. an implantable output converter which is directly connected to an ossicle and prompts said ossicle to vibrate.

The starting point of the invention is a hearing aid device, with which test signals can be generated in the hearing aid device and can be output via the earpiece. After passing through the feedback path, the test signals are recorded by the microphone of the hearing aid device and are subsequently evaluated. A comparison of this response signal with the outputted test signal allows conclusions to be drawn from the feedback path. Suitable measures for feedback suppression can then be implemented. By way of example, parameters of an adaptive feedback compensation filter can be adjusted such that a compensation of fed back signal parts takes place in the input signal of the microphone.

The basic idea behind the invention is thus to use such signals as test signals, said signals already being generated in the hearing aid device and being output via the output converter. These signals serve for instance to inform the user about current adjustments of the hearing aid device. Adjustments of this type can relate for instance to the volume adjustment or the adjustment of the current hearing program. Furthermore, the emitted signals which can be perceived by the user and used as test signals to estimate the feedback path, serve to inform the user about specific system states of the hearing aid device. System states of this type are for instance the charge state of the voltage source used. Furthermore, the hearing aid device according to the invention preferably offers a plurality of further signals which can be generated in the hearing aid device and can be perceived by the user, such as for instance also with mobile telephones. These can relate to references to specific times, deadlines etc. The outputted signals can serve to inform the user (announcements, word notifications, names, addresses etc), or can be emitted to entertain the user. These can also relate to such signals which are generated, if required, by means of a signal generator in the hearing aid device, but also to such signals, which are stored in a memory of the hearing aid device and are only read out if required.

Furthermore, the used signals can also originate in an external device, e.g. a remote control for the hearing aid device, and are first transmitted from there to the hearing aid device as an electromagnetic signal, this then being converted into an acoustically perceivable signal and emitted from said hearing aid device.

The reference signals which can be emitted by the hearing aid device are preferably designed such that they cover the widest possible range of the frequency spectrum which can be transmitted by the hearing aid device. This ensures that the feedback path is similarly evaluated in a wide frequency range.

The invention is advantageous in that the emission of reference signals is desired by the user and is thus not deemed as interfering. The reference signals can be emitted at a volume which lies far above the volume of permanent, below threshold test signals. This significantly improves the measurement of the feedback path.

As a result of the numerous possible situations in which reference signals can be expediently emitted, the feedback path can be measured at relatively short time intervals, without these being deemed by the user as interfering.

An analysis of the response signal recorded by the input converter allows the frequencies or frequency ranges, which have been particularly intensively fed back, to be recognized. One embodiment of the invention provides that filters available in the signal path of the hearing aid device between the input converter and the output converter are adjusted such that specific frequencies or frequency ranges which are particularly intensively fed back are filtered. Notch-filters can be used for instance so as to selectively suppress specific frequencies.

Another embodiment of the invention provides for an adaptive filter, for which filter parameters are generated on the basis of the response signal resulting from the emitted reference signal, such that the expected feedback signal is subtracted from the microphone input signal. This embodiment is advantageous in that generally no restriction is required in the case of the frequency spectrum which can, in principle, be transmitted by means of the hearing aid device.

BRIEF DESCRIPTION OF THE DRAWINGS

The invention is described below with reference to a FIGURE which shows a block diagram of a hearing aid device.

DETAILED DESCRIPTION OF THE INVENTION

The invention is described below in more detail with reference to an exemplary embodiment. The FIGURE shows the significantly simplified block diagram of a hearing aid device with a microphone 1 for recording an acoustic input signal and converting said signal into an electrical signal. The electrical signal is fed to a signal processing unit 2 to frequency-dependently amplify the input signal and to balance the individual hearing loss of a user. The processed signal is finally converted into an acoustic output signal AS by an earpiece 3 and is emitted into the auditory canal of a user.

As can be inferred from the FIGURE, a part of the output signal AS emitted by the receiver 3 reaches the microphone 1 across the feedback path. The feedback signal RS thus forms a part of the input signal ES into the microphone 1. The transmission function for the feedback signal RS is thus indicated in the block diagram with HR. If the conditions relating to the phase and the amplification for the feedback signal RS required for the occurrence of feedbacks are fulfilled with this configuration, this results in unwanted feedback whistling.

The hearing aid device according to the exemplary embodiment comprises a signal source 4, by means of which reference signals generated or stored in the hearing aid device can be emitted via the earpiece 3. By way of example, the reference signals serve to inform the user about certain adjustments of the hearing aid device, for instance the adjusted hearing program or the adjusted volume. Furthermore, the user can be made aware of certain system states of the hearing aid device by means of the reference signals, for instance the charge state of the voltage source (not shown). Furthermore, a plurality of further reference signals is possible, by means of which the user automatically makes him/herself aware of certain events or is provided with specific information on call. Examples of this are a time announcement or the recall of certain items of information previously stored in a memory, such as names, addresses, telephone numbers etc, which can be recalled as voice signals.

The used reference or information signals are preferably specially adapted to the particular use as test signals for estimating the feedback path. In particular, the information signals cover the widest possible range of the frequency spectrum which can be transmitted by the hearing aid device, so that the feedback behavior can be tested for precisely this frequency range. Thus the information signals are preferably not individual sounds, but instead sound sequences, melodies or noises etc.

During the emission of an information signal, the normal signal path through the hearing aid device from the microphone 1 via the signal processing unit 2 to the receiver 3 is advantageously interrupted, or at least heavily attenuated, so that during the emission of an information signal the output signal AS does at least essentially not contain other signal parts in addition to the information signal. This simplifies the measurement of the transmission behavior for the feedback path.

The feedback signal RS received at the microphone 1 following the emitted information signal is fed in the hearing aid device to a measuring, evaluation and control device 5, in which a comparison of the received signal takes place with the signal emitted via the signal source 4. The comparison allows conclusions to be drawn from the feedback path and in particular the transmission function HR. Countermeasures can be introduced in the hearing aid device from the data obtained in such a way, so that unwanted feedback whistling is also prevented during normal operation of the hearing aid device. To this end, filter parameters can be adjusted on the one hand in the signal processing unit 2, such that individual frequencies or frequency ranges which are particularly intensively affected by feedbacks are attenuated by adjustable filters in the signal processing unit 2. On the other hand, the hearing aid device according to the exemplary embodiment comprises an adaptive filter 6, by means of which the expected feedback signal is mapped and is subtracted from the microphone signal so as to obliterate the feedback signal RS recorded by the microphone 1. To achieve this, corresponding filter parameters are generated in the measuring, evaluation and control device 5, and are adjusted with the adaptive filter 6.

The invention is advantageous in that the use of information signals, which can be emitted by the hearing aid device at many opportunities, and are desired by the user and are thus sensed as not being interfering, ensure a good adaptation of the adaptive filter 6.

The invention claimed is:

1. A hearing aid device, comprising:

an input converter for recording an input signal and converting the input signal into an electrical signal;

a signal processing unit for processing the electrical signal;

an output converter for converting the processed electrical signal into an output signal which is perceived by a user as an acoustic signal;

a feedback reduction device for an adjustable reduction or attenuation of a feedback signal contained in the input signal which is a part of the output signal and feedback through a feedback path;

a signal source for emitting an information signal through the output converter, wherein the information signal comprises a voice containing informational details pertinent to the user, wherein the information signal is acoustically perceived by the user so that the user receives the informational details;

a measuring device for detecting a response signal originating from the emitted information signal; and an evaluation and control device to evaluate the information signal relative to the response signal to obtain a measurement of the feedback path, the evaluation and control device arranged to adjust at least one of a plurality of parameters of the feedback reduction device as a function of the measurement of the feedback path.

2. The hearing aid device as claimed in claim 1, wherein the information signal is generated in the hearing aid device.

3. The hearing aid device as claimed in claim 1, wherein the information signal is stored in a memory of the hearing aid device.

4. The hearing aid device as claimed in claim 1, wherein the information signal informs the user of an adjustment or state of the hearing aid device.

5. The hearing aid device as claimed in claim 1, wherein the information signal is an announcement of an event or contact information.

6. The hearing aid device as claimed in claim 1, wherein the information signal covers a range of a frequency spectrum which is transmitted by the hearing aid device.

7. The hearing aid device as claimed in claim 1, wherein a plurality of parameters of the feedback reduction device are adjusted for the adjustable reduction of the feedback signal.

8. The hearing aid device as claimed in claim 1, wherein the feedback reduction device attenuates a specific frequency or a frequency range.

9. The hearing aid device as claimed in claim 1, wherein the feedback reduction device is a filter.

10. The hearing aid device as claimed in claim 1, wherein the feedback reduction device is an adaptive filter.

11. A method for feedback suppression of a hearing aid device, comprising:

recording an input signal and converting the input signal into an electrical signal;

processing the electrical signal;

converting the processed electrical signal into an output signal which is perceived by a user as an acoustic signal;

reducing or attenuating a feedback signal contained in the input signal which is a part of the output signal and feedback through a feedback path;

emitting an information signal through the output converter;

providing through a voice in the information signal informational details pertinent to the user;

the user acoustically perceiving the information signal so that the user receives the informational details;

detecting a response signal originating from the emitted information signal;

evaluating the response signal relative to the information signal to obtain a measurement of the feedback path; and determining and adjusting at least one of a plurality of parameters of a feedback reduction device based on the measurement of the feedback path.

12. The hearing aid device as claimed in claim 11, wherein the information signal is generated in the hearing aid device.

13. The hearing aid device as claimed in claim 11, wherein the information signal is stored in a memory of the hearing aid device.

14. The hearing aid device as claimed in claim 11, wherein the information signal informs the user of an adjustment or state of the hearing aid device.

15. The hearing aid device as claimed in claim 11, wherein the information signal is an announcement of an event or contact information.

16. The hearing aid device as claimed in claim 11, wherein the information signal covers a range of a frequency spectrum which is transmitted by the hearing aid device.

17. The hearing aid device as claimed in claim 11, wherein a plurality of parameters of the feedback reduction device are adjusted for a reduction of the feedback signal.

18. The hearing aid device as claimed in claim 11, wherein the feedback reduction device attenuates a specific frequency or a frequency range.

19. The hearing aid device as claimed in claim 11, wherein the feedback reduction device is a filter.

20. The hearing aid device as claimed in claim 11, wherein the feedback reduction device is an adaptive filter.

* * * * *